United States Patent [19]

Owen

[11] 4,328,786

[45] May 11, 1982

[54] COAL BURNING GRATE

[75] Inventor: Douglas B. Owen, Toowoomba, Australia

[73] Assignee: Clayware Pty. Ltd., Toowoomba, Australia

[21] Appl. No.: 98,841

[22] Filed: Nov. 30, 1979

[51] Int. Cl.[3] ..... F23H 7/08

[52] U.S. Cl. ..... 126/174; 126/169; 110/281

[58] Field of Search ..... 126/152 B, 174, 175, 126/167, 169; 110/281-285, 288, 268, 289, 290, 291; 34/164; 414/187, 198; 198/633, 609, 758, 771

[56] References Cited

U.S. PATENT DOCUMENTS 512,735 1/1894 Muller ..... 110/285

1,402,419 1/1922 Harrington ..... 110/281

1,513,987 11/1924 Hare ..... 110/268

FOREIGN PATENT DOCUMENTS 692600 11/1930 France ..... 110/281

1124156 10/1956 France ..... 110/281

2233564 1/1975 France ..... 110/281

7085 of 1900 United Kingdom ..... 110/281

*Primary Examiner*—James C. Yeung

*Attorney, Agent, or Firm*—Schwartz, Jeffery, Schwaab, Mack, Blumenthal & Koch

[57] ABSTRACT

A coal burning grate for furnaces which is reciprocatably mounted to feed coal from a hopper into the furnace and to simultaneously remove ash from the furnace to an external ashpit. The grate may include a heel attached to the grate shoe to move ash in the ash pit to assist in the removal of the ash from the furnace.

6 Claims, 2 Drawing Figures

COAL BURNING GRATE

BACKGROUND OF THE INVENTION

1. Field of the Invention

This invention relates to an improved grate for coal burning in furnaces such as those used for kilns in the ceramic industry, steam boilers and the like.

2. Description of the Prior Art

A major problem with known coal burning grates is to provide efficient and simple methods of feeding fresh coal into the furnace and removing the ash, which remains in the furnace after combustion is deposited under the grate of the furnace.

BRIEF SUMMARY OF THE INVENTION

It is an object of the present invention to provide a coal burning grate which can simultaneously feed coal to the furnace and remove the burnt ash therefrom. It is a preferred object to provide a furnace to which secondary air, to minimise smoke-emission when burning high volatile coals, can be easily supplied.

A further preferred object is to provide a grate which is efficient in operation and easily manufactured.

Further preferred objects of the invention will become apparent from the following description.

Generally, the invention resides in a coal burning grate for a furnace including grate bars mounted for reciprocating movement, coal supply means at one end of the grate bars, a shoe attached below the other end of the grate bars; an ash receptacle means adjacent the shoe and said other end of the grate bars; and reciprocating means for said grate bars, wherein reciprocating movement of the grate bars simultaneously feeds coal into the furnace and the shoe removes the burnt ash which is formed in the ash receptacle means.

BRIEF DESCRIPTION OF THE SEVERAL VIEWS OF THE DRAWING

A preferred embodiment of the invention will now be described with reference to the accompanying drawings in which.

DETAILED DESCRIPTION OF THE PREFERRED EMBODIMENT

Figure 1:
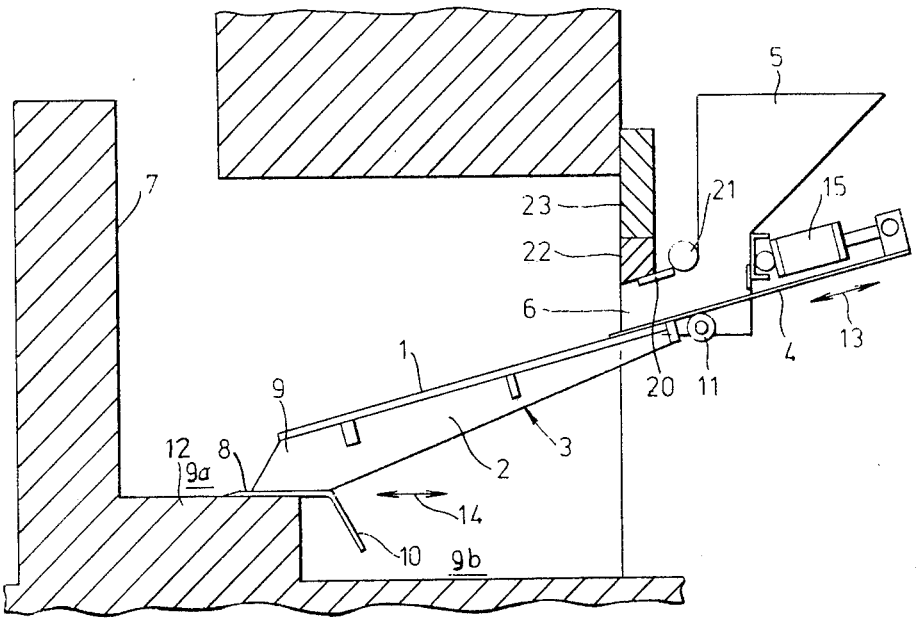
FIG. 1 is a sectional view of the grate taken on Section II—II of FIG. 2.
Figure 2:
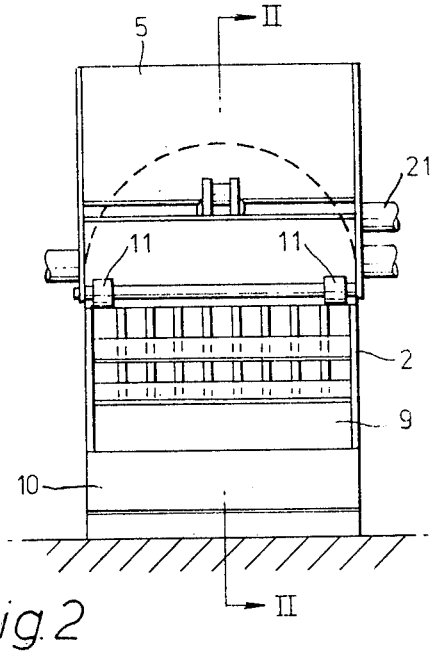
FIG. 2 is an end view of the grate.

A number of parallel iron grate bars 1 are carried in spaced relationship on an iron frame 2 to form the grate 3. Secured to one end of the bars 1 is a metal plate 4 which forms the bottom of a feeding hopper 5 which contains the coal to be burned. The feeding hopper 5 has an opening 6 to admit coal into the furnace 7. The top of the opening 6, which may be adjustable, is formed by the cross bar 20 and secondary air pipe 21. A refractory block 22 and inspection door 23 insulate the hopper from radiation from the furnace.

At the other end of the bars 1, a metal shoe 8 is attached to the frame 2, leaving a space 9 between the shoe 8 and bars 1 through which burnt ash from the ash receptacle 9*a* may pass. The shoe has a heel 10 projecting downwards from the shoe 8 to assist in clearing the ash which has passed through the space 9 to the ash pit 9*b* under the grate 3. The ash pit 9*b* is external to the furnace 7.

The grate 3 is supported at the hopper end by rollers 11 or other suitable means, and at the shoe end by brickwork 12 under the shoe 8 or other suitable means.

The grate is free to move with a reciprocating motion in the direction of the arrows 13 at the hopper end and arrows 14 at the shoe end. The rate of coal fed to the furnace can be adjusted by either varying the length of stroke of the grate or its speed of reciprocation, or by adjustment to the depth of the opening 6.

A hydraulic or pneumatic cylinder 15 is secured to the hopper 5 and its respective ram to the metal plate 4 to reciprocate the grate.

Once a fire has been established on the grate, the grate is operated as follows:

On the outward stroke, the grate slides under the burning coal and under the fresh coal in the hopper 5 while the shoe 8, carrying some ash in the space 9 with it, leaves a depression in the remaining ash in the ash receptacle 9*a* at the end of the bars 1, into which the ash which is no longer supported by the ends of the bars 1 may settle. At the same time the heel 10 pushes any accumulated ash in the ash pit 9*b* outwards from the shoe end of the grate. The ash receptacle 9*a* and space 9 provide the "ash receptacle means" in the interior of the furnace.

On the forward stroke, the grate carries fresh coal from the hopper 5 into the furnace 7. At the same time the shoe 8, travelling forward into the ash receptacle 9*a* is unable to carry its previous load of ash in space 9 with it and this ash is pushed off the shoe 8 into the cavity left in the ash pit 9*b* by the advancing shoe 8 and heel 10.

At all times, the ash carried by the shoe 8 and the ash through which the shoe moves automatically maintains an ash seal to prevent the entry of unwanted air to the furnace. When operated in this manner, the single structure which forms the grate is able to simultaneously feed coal into the furnace and remove the burnt ash which is formed in the ash receptacle 9*a*.

The grate may be mounted either horizontal or sloping, as required.

To reduce smoke emission when using high-volatile coals, the insulating block 22 may be raised slightly to leave a gap between itself and the cross bar 20, through which secondary air may be either drawn by the furnace draught, or blown under pressure from a row of holes or a slot in the secondary air pipe 21.

Various other changes and modifications can be made to the embodiments described without departing from the scope of the present invention.

I claim:

1. A coal-burning grate for a furnace, comprising:

(a) a feed hopper for feeding coal to the interior of said furnace;

(b) a grate member mounted for reciprocating movement, one end of said grate member being positioned adjacent to and below said hopper, said grate member receiving coal from said hopper and supporting the same during combustion thereof as it passes downwardly over said grate member;

(c) a shoe attached to the other end of said grate member and spaced from the surface of said grate member, said shoe engaging and being slidably supported on the floor of the furnace, the space between said shoe and the surface of said grate member, and the area in front of said grate member, defining an ash receptacle area in the furnace;

(d) means for reciprocating said grate member, whereby when said grate member is moved rearwardly it is in a position to receive fresh coal from the bottom of said hopper, with said shoe simultaneously carrying burnt ash rearwardly from said ash receptacle area thus permitting ash from above said grate member and which is no longer supported thereby to drop into said ash receptacle area; subsequent forward movement of said grate member serving to carry fresh coal into the furnace and simultaneously effecting contact of the burnt ash carried rearwardly with said shoe with the burnt ash subsequently dropped into said ash receptacle area, as a result of which the burnt ash carried by said shoe is pushed off into an ash pit under said furnace, the ash carried by said shoe and located in said ash receptacle area providing an ash seal preventing the entry of unwanted air into the furnace.

2. A grate as claimed in claim 1 wherein the feed hopper includes a plate fixed at said one end of the grate member and forming a movable bottom of the hopper.

3. A grate as claimed in claim 1 wherein said shoe is provided with a downwardly projecting heel which projects into said ash pit under said furnace for clearing burnt ash from the pit when said grate member is reciprocated rearwardly.

4. A grate as claimed in claim 1 wherein said grate member comprises grate bars mounted in spaced relationship on a frame, said one end of said grate member being supported on rollers, and said other end being supported by said shoe on a raised portion of the floor of the furnace.

5. A grate as claimed in claim 1 wherein said reciprocating means comprises a hydraulic cylinder mounted between the feed hopper and the grate member.

6. A grate as claimed in claim 1 further including means to introduce secondary air into the furnace to reduce smoke emission from the furnace.

* * * * *